US009605552B2

(12) United States Patent
Wondrasek et al.

(10) Patent No.: US 9,605,552 B2
(45) Date of Patent: Mar. 28, 2017

(54) NON-INTEGRAL SEGMENTED ANGEL-WING SEAL

(71) Applicant: General Electric Company, Schenectady, NY (US)

(72) Inventors: Michael Anthony Wondrasek, Simpsonville, SC (US); Nicholas Alvin Hogberg, Greenville, SC (US)

(73) Assignee: General Electric Company, Schenectady, NY (US)

( * ) Notice: Subject to any disclaimer, the term of this patent is extended or adjusted under 35 U.S.C. 154(b) by 753 days.

(21) Appl. No.: 13/913,920

(22) Filed: Jun. 10, 2013

(65) Prior Publication Data

US 2014/0363279 A1 Dec. 11, 2014

(51) Int. Cl.
*F01D 11/00* (2006.01)
*F01D 5/30* (2006.01)

(52) U.S. Cl.
CPC ..... *F01D 11/006* (2013.01); *F01D 5/3015* (2013.01); *F01D 11/001* (2013.01)

(58) Field of Classification Search
CPC .... F01D 11/005; F01D 11/006; F01D 11/001; F05D 5/32; F05D 5/326; F05D 5/3015; F05D 2260/30
See application file for complete search history.

(56) References Cited

U.S. PATENT DOCUMENTS

| | | | | |
|---|---|---|---|---|
| 5,800,124 | A | 9/1998 | Zelesky | |
| 6,190,131 | B1 | 2/2001 | Deallenbach | |
| 6,499,945 | B1 | 12/2002 | Lathrop | |
| 7,371,044 | B2 | 5/2008 | Nereim | |
| 8,007,230 | B2 | 8/2011 | Hafner | |
| 8,128,373 | B2 | 3/2012 | Webb | |
| 2005/0249590 | A1* | 11/2005 | Marchi | F01D 5/081 415/182.1 |
| 2010/0196164 | A1 | 8/2010 | Liotta et al. | |
| 2010/0232938 | A1 | 9/2010 | Harris, Jr. et al. | |
| 2012/0275920 | A1* | 11/2012 | Delvaux | F01D 5/3015 416/204 R |

* cited by examiner

*Primary Examiner* — Gregory Anderson
*Assistant Examiner* — Maxime Adjagbe
(74) *Attorney, Agent, or Firm* — Nixon & Vanderhye P.C.

(57) ABSTRACT

A cover plate adapted to axially overlie root or shank portions of one or more buckets or blades secured to a turbomachine wheel, includes an arcuate cover plate body adapted to be secured to the turbomachine wheel so as to cover a root portion of at least one of the turbine buckets or blades; and at least one arcuate angel-wing seal segment detachably secured to one side of the arcuate cover plate body.

17 Claims, 3 Drawing Sheets

NON-INTEGRAL SEGMENTED ANGEL-WING SEAL

The present invention relates generally to seals related to the flow of combustion gases in turbomachines, and specifically, to cover plates supporting seals (for example, so-called "angel-wing" seals) that over-lie the root portions of blades or buckets in the compressor and/or turbine sections of such machines.

BACKGROUND OF THE INVENTION

Cover plates are generally used on turbomachine wheels, along the upstream and downstream faces of buckets or blades mounted on the wheels. The cover plates often support axially-projecting seals, generally referred to as angel-wings seals, that interact with seal lands on adjacent stationary and/or rotating hardware. These seals are intended to prevent both the ingress of hot gases into the rotor wheelspace radially inward of the buckets or blades, and the egress of the cooler wheelspace air into the hot gas path. The angel-wing seals may be integrally cast with the bucket or blade, or may comprise non-integral, separate plates mechanically assembled along axial faces of the wheel so as to cover one or more root portions of the buckets or blades. Examples of non-integral cover plates formed with integral angel-wing seals are disclosed in, for example, U.S. Pat. No. 6,190,131 and in U.S. Published Application 2010/0232938 A1.

There are occasions, however, when it is desired to utilize bucket or blade designs that are unable to accommodate the usual angel-wing seal configurations. For example, in a short-shank bucket or blade design, the shorter shank portions adjacent the bucket or blade root portions do not provide sufficient room for conventional angel-wing seals which, in many applications, are provided in a double-stacked arrangement with radially-spaced inner and outer seal elements.

There remains a need, therefore, for a unique turbomachine angel-wing seal arrangement conducive to the use of various bucket and blade designs.

BRIEF SUMMARY OF THE INVENTION

In one exemplary but nonlimiting embodiment, the invention relates to a cover plate adapted to axially overlie root and/or shank portions of one or more buckets or blades secured to a turbomachine wheel comprising an arcuate cover plate body adapted to be secured to the turbomachine wheel so as to cover a root and/or shank portion of at least one of the turbine buckets or blades; and at least one arcuate angel-wing seal segment detachably secured to one side of the arcuate cover plate body.

In another exemplary aspect the invention provides a wheel for a turbomachine rotor rotatable about an axis, the wheel comprising a plurality of circumferentially-spaced bucket or blade slots receiving generally complimentary-shaped end portions of turbomachine buckets or blades, the buckets or blades each comprising a shank, a root portion and an airfoil portion; a circumferential array of cover plate segments axially overlying at least part of the shanks and the root portions of the buckets or blades, each of the cover plate segments comprising a cover plate body attached to the wheel; and one or more fastening elements provided on one side of the cover plate body for securing at least one seal segment on the one side of the cover plate body, the seal segment having at least one seal flange extending in a generally axial direction.

In still another aspect the invention provides a wheel for a turbomachine rotor rotatable about an axis, the wheel comprising a plurality of circumferentially-spaced, substantially axially-extending bucket or blade slots receiving generally complementary-shaped mounting portions of turbomachine buckets or blades; a circumferential array of a cover plate segments overlying end portions of the buckets or blades and portions of a face surface of the wheel; each cover plate segment comprising a cover plate body having at least one arcuate flange extending from one side of the cover plate for securing the cover plate in a generally complementary-shaped slot in the wheel; and a plurality of arcuate angel-wing seal segments detachably secured to respective cover plate bodies.

The invention will now be described in greater detail in connection with the drawings identified below.

DETAILED DESCRIPTION OF THE INVENTION

Figure 1:
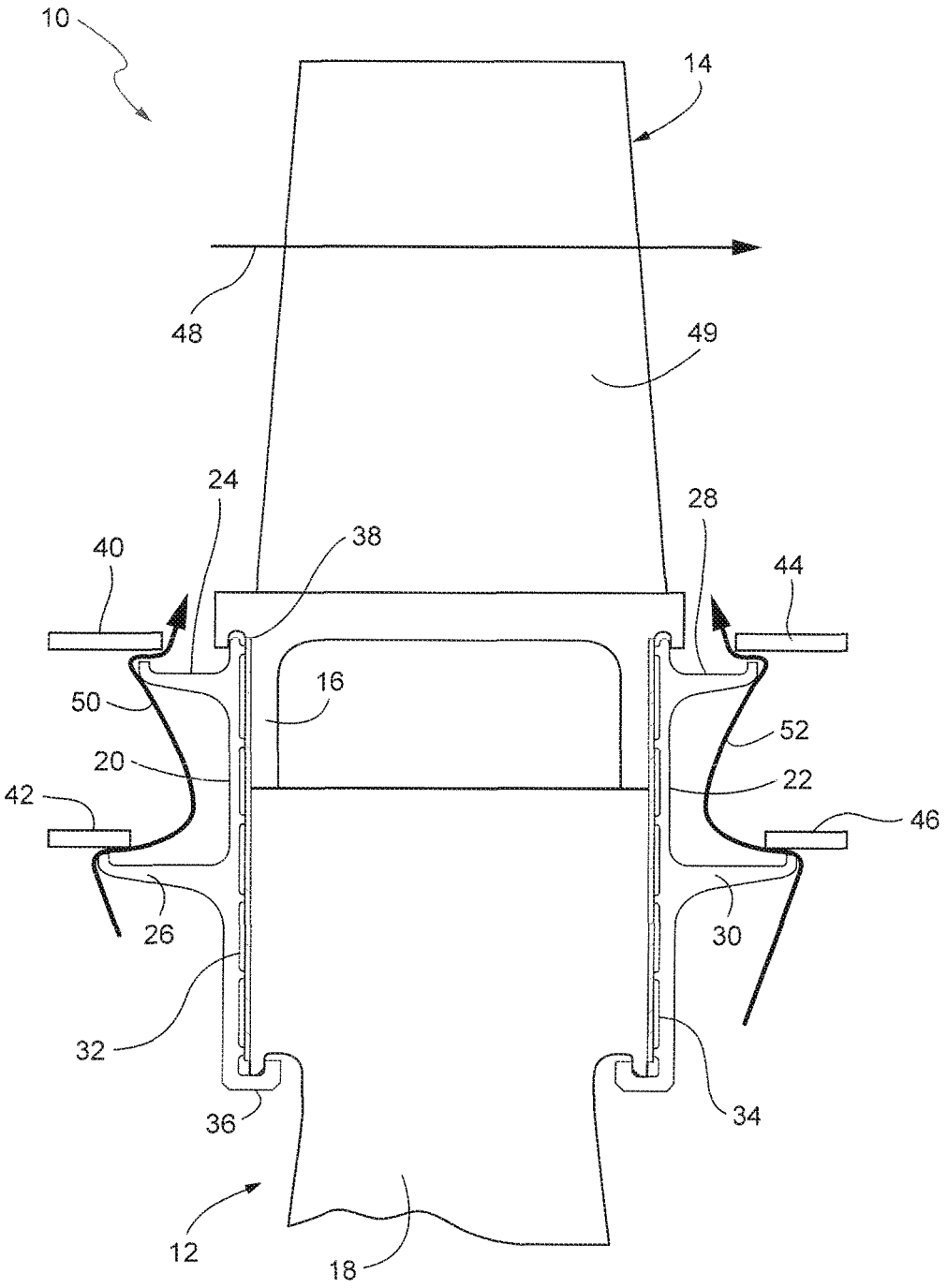
FIG. 1 Prior Art
FIG. 1 is a schematic section view of a conventional cover plate and angel-wing seal configuration for a turbomachine bucket or blade.

FIG. 1 shows a cross-sectional view of a relevant portion of a turbomachine 10 which includes a rotor or shaft (not shown) mounting a plurality of wheels 12 (one shown). Each wheel supports an annular array of buckets 14 (one shown), and each wheel is flanked by stationary vanes (not shown) or other static or rotating hardware. The manner in which stationary vanes of the upstream nozzle feed combustion gases or steam to the rotating buckets to drive the wheels and rotor is well known and need not be described here in any further detail.

It will be appreciated that the term "bucket" usually refers to the airfoil-shaped vanes (and associated mounting portion) employed in the turbine section(s) of turbomachines, while the term "blade" usually refers to the airfoil-shaped vanes (and associated mounting portions) typically employed in the compressor section of the machines. While the description below refers to "buckets", it is to be understood that the seal configurations are applicable to both buckets and blades in the respective turbine and compressor sections of turbomachines.

The axially-facing sides of the shank and dovetail or root portions 16, 18, respectively, of buckets 14 are typically covered by cover plates 20, 22, each of which may have no angel-wing seals, or may be provided with one or more angel-wing seals. In the example shown, two such seals 24, 26 are provided on the upstream cover plate 20 and two similar seals 28, 30 are provided on the downstream cover plate 22. It will be appreciated that in other examples, one or more than two such seals may be employed. Additional seals 32, 34 may be located between the cover plates and the wheel. The cover plates 20, 22 may be secured to the wheel 12 in various ways, for example, by means of a hook and slot arrangement shown at 36, 38, or by other conventional means such as, for example, bolts, pins, bayonet-type retaining ring or any combination thereof. Angel wing seals 24, 26 and 28, 30 typically cooperate with seal lands 40, 42 and 44, 46, respectively, formed on the adjacent nozzle diaphragms and support rings, or other turbomachinery hardware, to form a tortuous path that limits ingestion of the combustion gases flowing along the hot gas path 48 (and across the airfoil portions 49 of the buckets 14) into the wheel space radially inward of the buckets. At the same time, the angel-wing seals control/minimize the amount of purge/cooling air (see flow arrows 50, 52) in the radially-inner wheelspace from escaping into the hot gas path.

In conventional arrangements, the cover plates 20, 22 may be provided in the form of one or more arcuate segments which combine to form a substantially complete 360° cover plate assembly. In those arrangements where cover plates are formed with angel-wing seals, the seals will also be segmented, and will also together form 360° seals.

In an exemplary but nonlimiting embodiment of the invention, the angel-wing seals are provided as discrete seal elements detachably mounted on respective cover plate segments. It will be appreciated that the discussion below applies to the cover plates on both the upstream and downstream sides of the buckets, but for convenience only one cover plate/angel-wing seal configuration will be described in detail.

Figure 2:
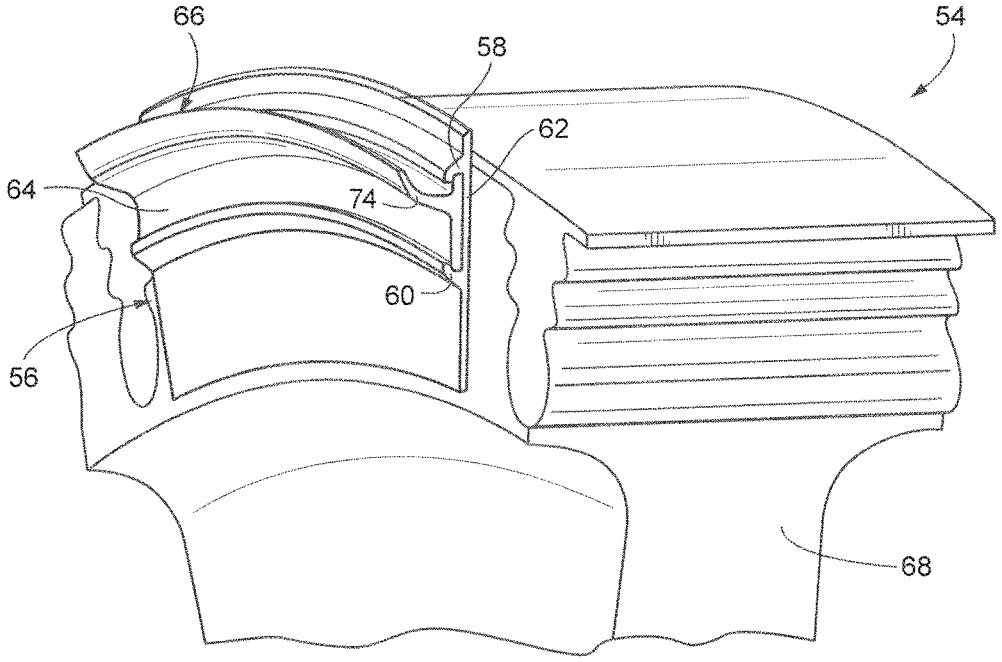
FIG. 2 is a partial perspective view illustrating a cover plate and non-integral angel-wing seal configuration in accordance with a first exemplary but nonlimiting embodiment of the invention.

With reference now to FIG. 2, an abbreviated illustration of a bucket 54 includes an arcuate cover plate segment body (or simply, cover plate) 56 in accordance with one exemplary embodiment. The cover plate is formed to include a pair of arcuate "hook" flanges 58, 60 extending from one side of the cover plate segment, and facing each other to thereby form a track or groove 62 for slidably receiving a base portion or rail 64 of an angel-wing seal segment 66. The cover plate 56 itself may be attached to the wheel 68 by any suitable, known retention devices (e.g., bolts, pins or the like) that hold the cover plates in all directions, and that need not be described further. The cover plate 56 may extend in a circumferential direction so as to cover the shank/root portions of one or more of the circumferential array of axially-loaded buckets 54. In practice, any number of cover plate segments can be employed, and the cover segments may, but are not required to align with individual buckets. It will be appreciated, however, that by overlapping the bucket dovetails and associated wheel slots, better sealing is achieved.

In this exemplary embodiment, the rail 64 of the angel-wing seal segment 66 supports a single angel-wing seal flange 74 of otherwise conventional size and shape.

Figure 3:
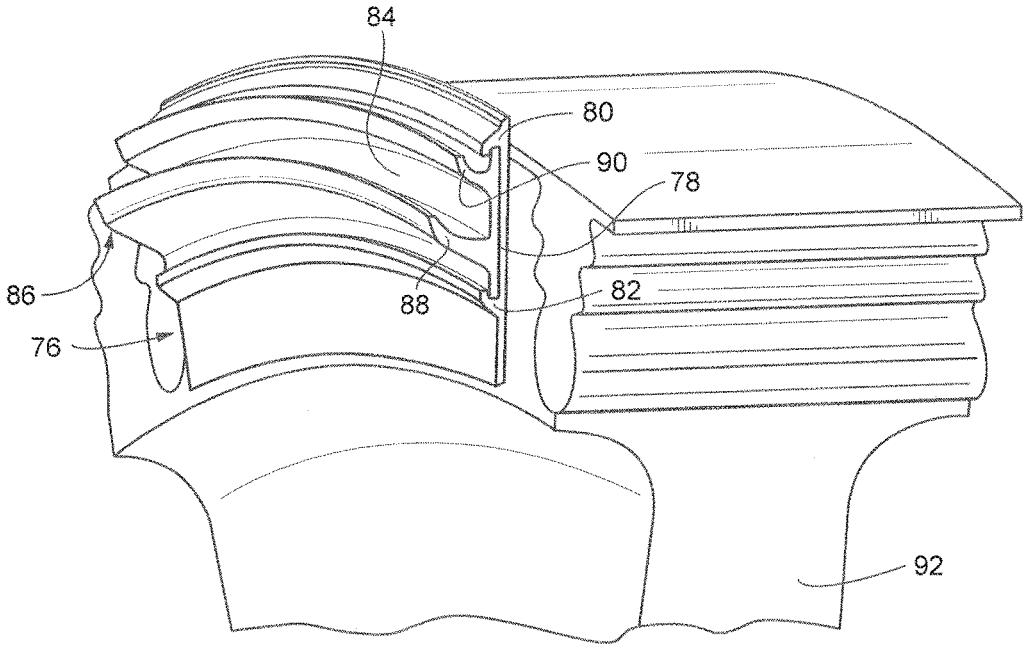
FIG. 3 is a partial perspective view illustrating a cover plate and non-integral angel-wing seal configuration in accordance with a second exemplary but nonlimiting embodiment of the invention.

In a variation illustrated in FIG. 3, the angel-wing seal segment may be provided with a pair of radially-spaced seals projecting from a single rail. More specifically, the cover plate 76 has been modified to provide a radially-enlarged track or groove 78 formed by oppositely-facing hook flanges 80, 82 so as to receive a radially-enlarged angel-wing seal base portion or rail 84. The angel-wing seal segment 86 incorporates a pair of inner and outer, radially-spaced angel-wing seal flanges 88, 90. The manner in which the cover plate 76 is attached to the wheel 92 may be as described above.

Figure 4:
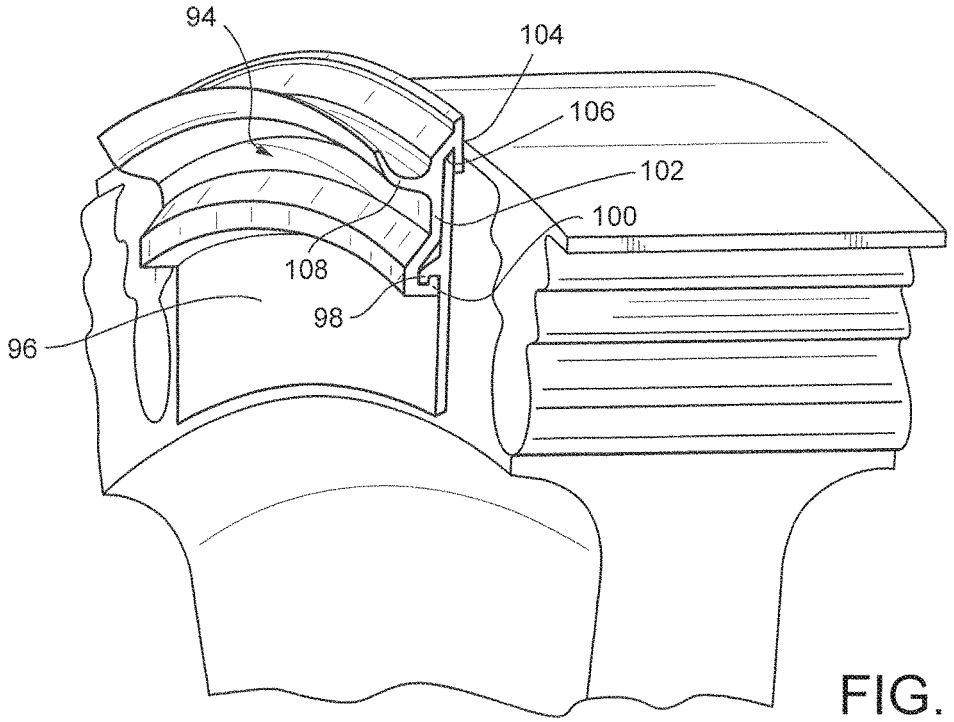
FIG. 4 is a partial perspective view illustrating a cover plate and non-integral angel-wing seal configuration in accordance with a third exemplary but nonlimiting embodiment of the invention.

In another variation shown in FIG. 4, the one or more fastening elements used to secure the separable angel-wing seal segment 94 to the cover plate 96 may include a downwardly- or inwardly-facing hook 98 formed on the cover plate 96. A outwardly-facing hook 100 at the radially-inward edge of the angel-wing base or rail 102 interlocks with the hook 98, and a radially inwardly-facing hook 104 formed on the radially outer edge of the angel-wing base or rail 102 is received over a radially outer edge 106 of the cover plate 96. In this embodiment, there is a single angel-wing seal flange 108.

Figure 5:
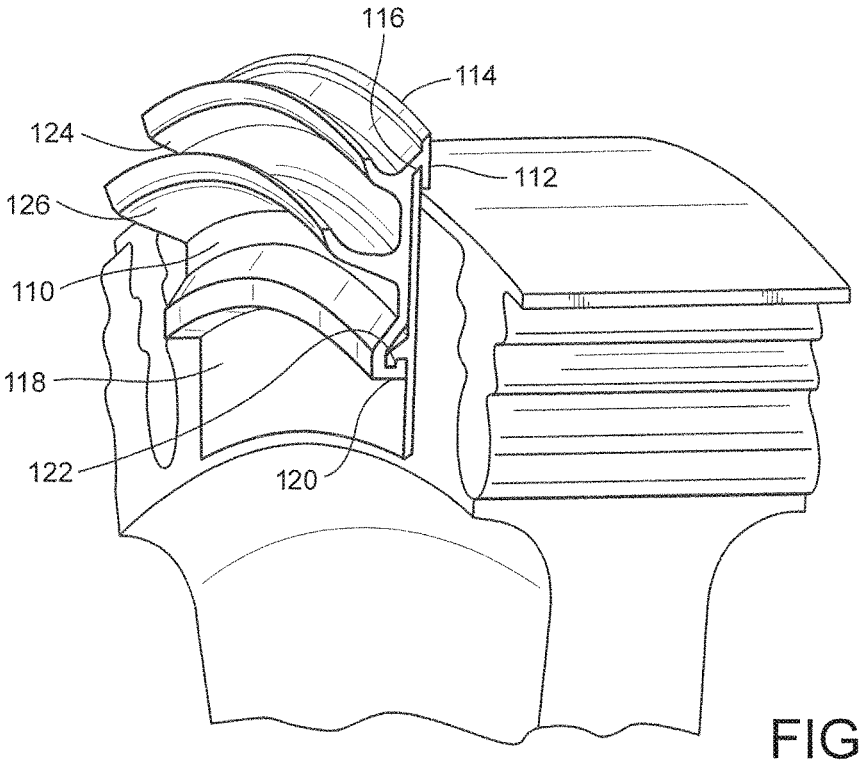
FIG. 5 is a partial perspective view illustrating a cover plate and non-integral angel-wing seal configuration in accordance with a fourth exemplary but nonlimiting embodiment of the invention.

FIG. 5 shows yet another configuration where a double angel-wing seal, similar to that shown in FIG. 3, is secured to a cover plate segment by means of an inner and outer hook arrangement as shown in FIG. 4. Specifically, the angel-wing base portion or rail 110 is provided with a radially inwardly-directed hook 112 at its radially outer edge 114, such that the hook 112 is received over the outer edge 116 of the cover plate 118. The radially inner end of the angel-wing seal base or rail 110 is provided with a radially outwardly-facing hook 120 that receives and mates with, a radially inwardly-facing hook 122 on the cover plate 118. This arrangement accommodates a pair of radially-spaced angel-wing seal flanges 124, 126.

It will be appreciated that the invention contemplates any suitable fastening arrangement between the angel-wing seal segment and the cover plate segment, as well as providing more than two radially-spaced angel-wing seals on an angel-wing seal segment.

For all of the described embodiments, it will be understood that the arcuate extent of the cover plate/angel-wing seal segments may vary. For example, the bucket or blade edges, cover plate edges, and seal edges may all be aligned; the cover plate edges and seal edges may be aligned but overlap the edges of one or more of the buckets or blades; or the the bucket or blade edges and cover plate edges may be aligned, with the seal edges overlapping one or more of the bucket or blade and cover plate edges It is also contemplated that the cover plates and angel-wing seal segments may be locked in desired circumferential positions by means of axially-extending pins, other hard stops, or other known retention methods which need not be described.

In addition, the non-integral arrangements described herein permit the use of different materials for the cover plates and angel-wing seal segments. For example, higher temperature-capable material may be used for the angel-wing seals and lower temperature-capable materials used for the cover plates.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiments disclosed as the best modes contemplated for carrying out this invention, but that the invention will include all embodiments falling within the scope of the appended claims.

What is claimed is:

1. A cover plate adapted to axially overlie root and/or shank portions of one or more buckets or blades secured to a turbomachine wheel, comprising:

an arcuate cover plate body adapted to be secured to the turbomachine wheel so as to cover a root portion of at least one of the buckets or blades, wherein said arcuate cover plate body is provided with a pair of radially-spaced arcuate hooks forming opposite sides of a track; and at least one arcuate angel-wing seal segment detachably secured to one side of said arcuate cover plate body, wherein the at least one arcuate angel-wing seal segment includes an angel wing seal projecting axially, and said at least one arcuate angel-wing seal segment is provided with an arcuate rail received within the track such that opposite edges of the arcuate rail each engage one of the arcuate hooks.

2. The cover plate according to claim 1 wherein the angel wing seal on the arcuate angel-wing seal segment comprises arcuate, radially-spaced angel wing seals.

3. The cover plate according to claim 1 wherein either or both of said arcuate cover plate body and said angel-wing seal overlap side edges of more than one of said buckets or blades.

4. A cover plate configured to axially overlie root and/or shank portions of one or more buckets or blades secured to a turbomachine wheel, the cover plate comprising:

an arcuate cover plate body configured to be secured to the turbomachine wheel to cover a root portion of at least one of the buckets or blades, wherein said arcuate cover plate body is provided with a radially projecting arcuate hook forming a groove; and at least one arcuate angel-wing seal segment detachably secured to one side of said arcuate cover plate body, wherein the at least one angel-wing seal segment includes an angel wing seal projecting axially, and wherein said at least one arcuate angel-wing seal segment is provided with an arcuate rail having a first-inner edge received within said groove and a second-outer edge is provided with a radially inwardly facing hook seated on a radially outer edge of said arcuate cover plate body.

5. A cover plate configured to axially overlie root and/or shank portions of one or more buckets or blades secured to a turbomachine wheel, the cover plate comprising:

an arcuate cover plate body configured to be secured to the turbomachine wheel so as to cover a root portion of at least one of the buckets or blades, wherein said arcuate cover plate body is provided with an arcuate hook configured to seat in an arcuate groove at a radially inner end of said arcuate angel-wing seal segment, and at least one arcuate angel-wing seal segment detachably secured to one side of said arcuate cover plate body, wherein the at least one angel-wing seal segment includes an angel wing seal projecting axially, and wherein a radially outer end of said angel-wing seal segment is configured to seat in a hook at a radially outer edge of said arcuate cover plate body.

6. A wheel for a turbomachine rotor rotatable about an axis, said wheel comprising:

a plurality of circumferentially-spaced bucket or blade slots receiving generally complimentary shaped end portions of turbomachine buckets or blades, said buckets or blades each comprising a shank, a root portion and an airfoil portion;

a circumferential array of cover plate segments axially overlying at least part of said shanks and said root portions of said buckets or blades, each of said cover plate segments comprising a cover plate body attached to said wheel, wherein said at least one of the cover plate segments includes an arcuate groove and said seal segment having at least one angel wing seal flange extending in a generally axial direction, wherein a radially inward edge region of the seal segment is detachably fastened to at least one of the cover plate segments and a radially outward edge region of the seal segment is fastened to the at least one of the cover plate segments, and wherein said at least one seal segment is provided with a rail with a first edge received within said arcuate groove and a second edge provided with a hook received over the radially outer edge of said cover plate segments.

7. The wheel according to claim 6 wherein said at least one of the cover plate segments includes a radially outwardly facing arcuate shaped hook and a radially inwardly facing arcuate shaped hook, wherein a track is defined between the hooks, and said at least one seal segment includes a rail configured to be seated within said track.

8. The wheel according to claim 6 wherein said angel wing seal flange includes a plurality of radially-spaced angel wing seal flanges.

9. The wheel according to claim 6 wherein either or both of said arcuate cover plate body and said seal segment overlap side edges of more than one of said buckets or blades.

10. The wheel according to claim 7 wherein said rail is provided with side edges overlapping at least one side edge of an underlying cover plate body.

11. A wheel for a turbomachine rotor rotatable about an axis, said wheel comprising:

a plurality of circumferentially-spaced bucket or blade slots receiving generally complimentary shaped end portions of turbomachine buckets or blades, said buckets or blades each comprising a shank, a root portion and an airfoil portion;

a circumferential array of cover plate segments axially overlying at least part of said shanks and said root portions of said buckets or blades, each of said cover plate segments comprising a cover plate body attached to said wheel, wherein said cover plate segments each include an arcuate shaped hook and the seal segment includes an arcuate groove seated in the hook, and said seal segment having at least one angel wing seal flange extending in a generally axial direction, wherein a radially inward edge region of the seal segment is detachably fastened to at least one of the cover plate segments and a radially outward edge region of the seal segment is fastened to the at least one of the cover plate segments, and wherein a radially outer end of said seal segment is provided with a hook seated on a radially outer edge of at least one of said cover plate segments.

12. A wheel for a turbomachine rotor rotatable about an axis, said wheel comprising:

a plurality of circumferentially-spaced, substantially axially-extending bucket or blade slots receiving generally complementary shaped mounting portions of turbomachine buckets or blades;

a circumferential array of a cover plate segments overlying end portions of said buckets or blades and portions of a face surface of said wheel;

each cover plate segment comprising a cover plate body attached to said wheel, wherein said cover plate body includes a pair of radially-spaced arcuate hooks defining there between a track; and a plurality of arcuate angel-wing seal segments detachably secured to respective cover plate bodies, wherein each of the arcuate angel-wing seal segments includes an angel wing seal flange projecting in an axial direction with respect to a rotational axis of the wheel, wherein said plurality of angel-wing seal segments are each provided with a rail received within the track.

13. The wheel according to claim 12 wherein said angel-wing seal flange includes plural angel-wing seal flanges.

14. The wheel according to claim 12 wherein each of said cover plate segments overlaps side edges of one or more adjacent buckets or blades, and each of said angel-wing seal segments is provided with side edges aligned with side edges of its respective cover plate segment.

15. The wheel according to claim 12 wherein each of said cover plate segments overlaps side edges of at least one of said buckets or blades, and each of said angel-wing seal segments overlaps at least one side edge of its respective cover plate segment.

16. The cover plate of claim 1 wherein said arcuate cover plate body and said at least one arcuate angel-wing seal segment are comprised of materials having the same or different temperature-capable properties.

17. A wheel for a turbomachine rotor rotatable about an axis, said wheel comprising:

circumferentially-spaced, substantially axially-extending bucket or blade slots configured to receive complementary shaped mounting portions of turbomachine buckets or blades;

a circumferential array of a cover plate segments overlying end portions of said buckets or blades and portions of a face surface of said wheel, wherein each cover plate segment includes a cover plate body attached to said wheel; and arcuate angel-wing seal segments detachably secured to respective ones of the cover plate bodies, wherein each of the arcuate angel-wing seal segments includes an angel wing seal flange projecting in an axial direction with respect to a rotational axis of the wheel, and wherein each of said angel-wing seal segments is provided with a rail with a first edge received within an arcuate groove in said cover plate segment and a second edge provided with a hook received over a radially outer edge of said cover plate body.

* * * * *